United States Patent [19]

Kuckhermann et al.

[11] Patent Number: 4,823,539

[45] Date of Patent: Apr. 25, 1989

[54] FORMING AND FILING DEVICE FOR CARDBOARD PACKAGE

[75] Inventors: Gustav Kuckhermann; Per-Ulf Hansson, both of Achern, Fed. Rep. of Germany

[73] Assignee: Icoma Packtechnik GmbH, Achern, Fed. Rep. of Germany

[21] Appl. No.: 89,371

[22] Filed: Aug. 26, 1987

[30] Foreign Application Priority Data

Aug. 28, 1986 [DE] Fed. Rep. of Germany ..... 3628952

[51] Int. Cl.[4] ..... B65B 43/34

[52] U.S. Cl. ..... 53/579; 53/578; 53/570; 198/465.2

[58] Field of Search ..... 53/578, 579, 570; 414/102; 198/465.2, 803.02

[56] References Cited

U.S. PATENT DOCUMENTS

| | | | |
|---|---|---|---|
| 1,909,319 | 5/1933 | Taylor | 53/570 |
| 2,383,352 | 8/1945 | Snyder | 53/469 |
| 2,903,120 | 9/1959 | Thomas | 198/465.2 |
| 3,014,321 | 12/1961 | Lesch | 53/575 X |
| 4,468,165 | 8/1984 | Kawasaki | 414/102 |
| 4,525,978 | 7/1985 | Hayase | 414/102 |
| 4,710,122 | 12/1987 | Villanueva | 198/465.2 |

FOREIGN PATENT DOCUMENTS

| | | | |
|---|---|---|---|
| 566159 | 11/1958 | Canada | 53/579 |

*Primary Examiner*—John Sipos

*Attorney, Agent, or Firm*—Pollock, Vande Sande & Priddy

[57] ABSTRACT

In an apparatus for forming, filling and closing packages made of cardboard, cassettes for receiving the package are provided, which may be rearranged in differing processing positions. These cassettes are designed in such a way that they may be either exchanged for one another altogether, or reset for various format sizes. With such a device, format resetting, which has heretofore required considerable retooling times for such devices, may be achieved in a very short time and without great difficulty.

12 Claims, 3 Drawing Sheets

FORMING AND FILING DEVICE FOR CARDBOARD PACKAGE

BACKGROUND OF THE INVENTION The present invention relates to an apparatus for the forming, filling and closing of a package made of cardboard. Such apparatuses are known in the art. They include a number of processing stations corresponding to the number of processing steps involved. The problem with such known machines is the change of the required packaging format. In resetting the formats, considerable re-tooling time is required. To eliminate disadvantages of the prior art machines, the present invention provides for an apparatus of this known type in which formatting can be achieved in a relatively simple and quick manner.

SUMMARY OF THE PRESENT INVENTION The solution to the prior art problems is accomplished according to the present invention by providing cassettes for the various formats. The cassettes are used for the transportation of the packaging to the processing stations, which are serially arranged. The provision of cassettes, which may either be entirely switched, or may be reset for the various formats, permits rapid re-tooling of the apparatus. The drive facilities for the transportation of the various packaging sizes to the various processing stations remain entirely unchanged during this process. All that is require is an adaptation of the cassettes to the various package sizes. Naturally, the usual adaptations of the filling devices and the closing devices are to be performed as well; these, however, are not the subject of the present invention.

In the following, a preferred embodiment of the present invention will be described with reference being made to the drawings in which:

DESCRIPTION OF THE PREFERRED EMBODIMENT

Figure 1:
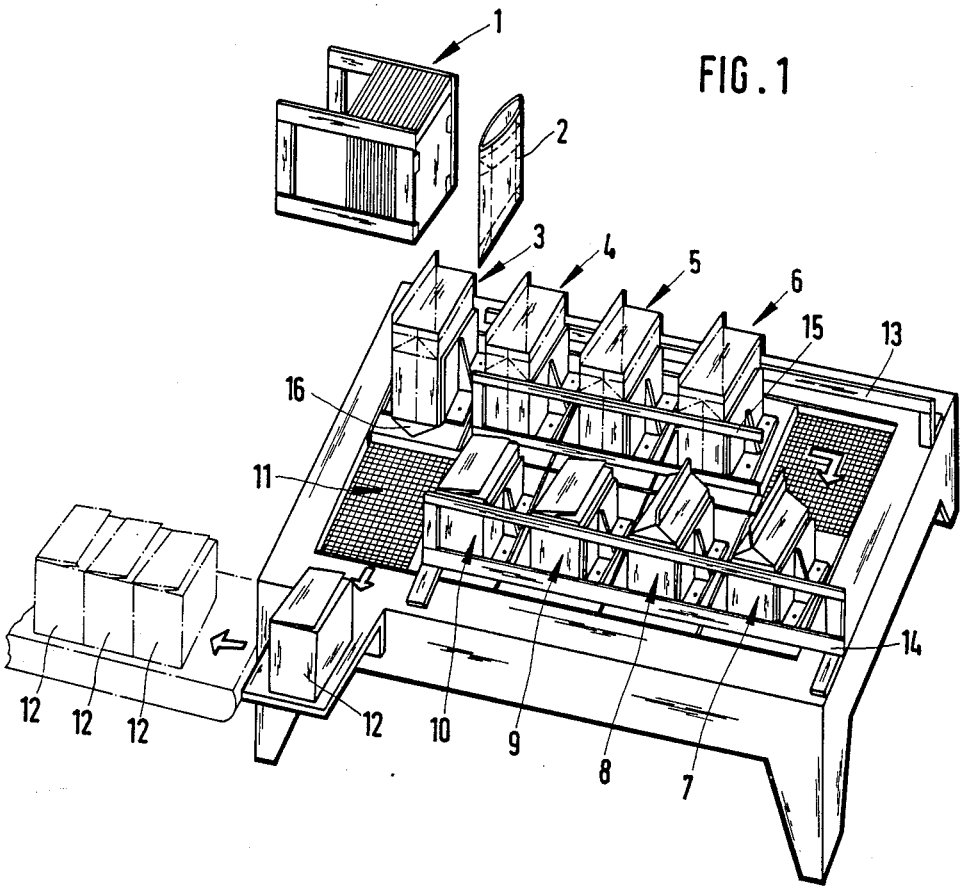
FIG. 1 shows a schematic perspective view of a transportation device for various processing stations, without the filling and closing devices, which are arranged above it.
Figure 2:
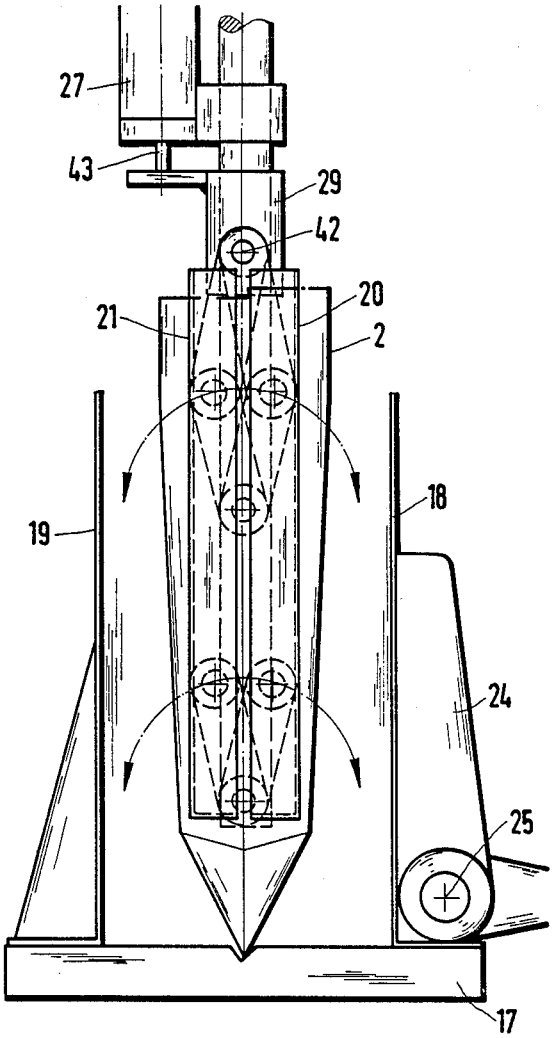
FIG. 2 shows a schematic side view of a spreading device for the package in inserted condition.
Figure 3:
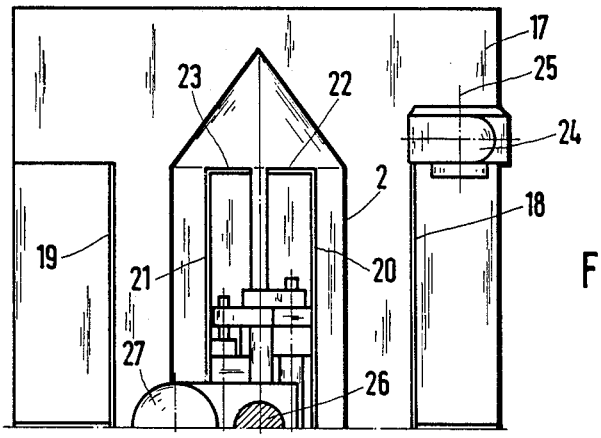
FIG. 3 shows a top view of the embodiment according to FIG. 2, with only one-half shown.
Figure 4:
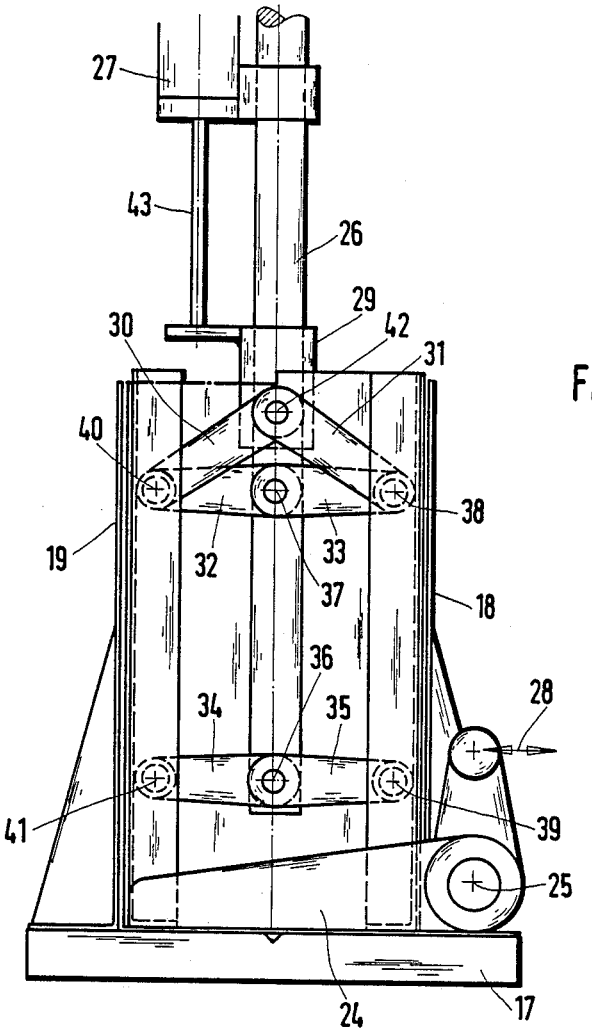
FIG. 4 shows a side view of the embodiment shown in FIG. 2, with the spreading device in spread condition.

In a magazine 1, flat packages 2 are arranged which may either have pre-folds, or may be prepared without any fold lines. These flat packages are laid into form station 3 in open form. After the completed spreading and opening, the packages reach the filling station 4, from which they proceed to the compression station 5 and finally to the refilling station 6.

The spread packages receive their right-angled form by means of the spreading device, the function of which will be described later, in connection with FIGS. 2–5.

In the spread condition, the packages rest on the vertical plates 18 and 19 with their wide sides, and with their bottoms, they rest upon the bottom plate 17. The bottom wall 17 and vertical walls 18 and 19 form a substantially U-shaped cassette. The side flaps 16 also rest upon the floor plate 17, of the cassette, where they are held tight by the pressure pads 24. After the spreading device has been pulled upward and out, the right-angle-shaped cardboard packages within cassettes pass through the various processing positions described. In this process, the narrow front sides of the package slide along the external glide strips 13, 14 and the internal glide strips 15 15 in the direction designated by arrows A, B, and C.

In FIG. 1, the rear longitudinal path with the processing stations 3, 4, 5 and 6 is shown. After leaving the refilling station 6, the package, which has been entirely filled reaches a free position, the end position of the rear longitudinal path. From there, a filled package is pushed transversely in the direction designated by arrow C to the frontal longitudinal path, up to the point where it meets the narrow front side at the external glide strips 14. Then, cassettes are moved along the frontal longitudinal path toward the left in the direction designated as arrow B, along with the packages located therein, as shown in FIG. 1. In this process, the packages first of all pass through the sealing station 7, the fold-over station 8, the turn-over and gluing station 9 and the finishing station 10. From the finishing station 10, the completed packages 12 pass on to the move-out station 11. At the move-out station 11, the completed, closed packages 12 are moved out transversely and laterally between the plates 18 and 19, thus reaching the receiving position.

In FIG. 1, the interior glide strips 15 are shown only in the rear longitudinal path. However, they are also provided in the same manner in the frontal longitudinal path, although they are not shown there. The glide strips 15, which lie adjacent to one another, which are shorter than external glide strips 13, 14 and terminate prior to the transverse moving stations, so that the packages may be moved transversely to the longitudinal path lying opposite.

It is also possible to attach a storage device to the device shown in FIG. 1.

The number of processing stations is variable. The device proves to be particularly advantageous for two longitudinal paths running parallel to one another, where each have transverse movement devices at their ends, which permits an alternating transfer from one longitudinal path to the adjacent longitudinal path. However, the packages move in opposite directions A, B in the two longitudinal paths. Advantageously, the drive of the cassettes with packages longitudinally and transversly is accomplished with the aid of a pusher system arranged right-angularly. The drive mechanism would advantageously include piston cylinder units units shown in FIG. 1 such as cylinders 101 and 102. The package 2, which is brought up in flat form, closed at the bottom, is formed into a right-angled package at the form station 3 by means of the profile plates 20 and 21, which are spread apart. In this process, the large sidewalls are pressed against the vertical plate 18 and 19 of the cassette. The bottom corners 16, which are formed in this process, are pressed flat with the aid of pressure pads 24 which can be designed as welding elements and serve as additional fastening during forward motion.

The spreading device shown in FIGS. 2–5 is constructed as follows:

The spreading device has the profile plates 20 and 21, with rounded off marginal areas 22 and 23, which are arranged parallel to one another and vertically. The profile plates 21 and 22 are connected, over the pivot axes 38 and 39, and 40 and 41, and the associated hinge levers 33 and 35, and 32 and 34, with a glide rod 26, in a hinged manner by means of the hinge axes 37 and 36. A glide piece 29 rests on the glide rod 26.

Hinge levers 30 and 31 are attached to the axis 42 of the glide piece 29; they end at the pivot axes 40 and 38.

Figure 5:
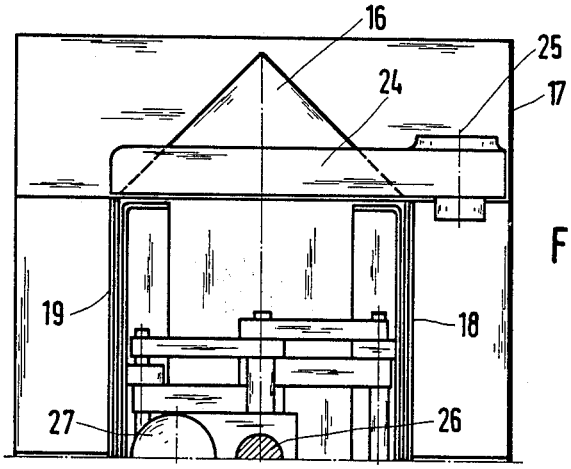
FIG. 5 shows a top view of the embodiment according to FIG. 4, with only one-half shown.

A piston cylinder unit 27 has a piston-rod 43 which is connected with a glide-piece 29. In the inserted condition of the spreading device, the glide piece 29 may glide downward when the piston rod 43 is withdrawn. In this process, the profile plates 20 and 21, which are in the vertical position and parallel to one another, are moved outward until the large sidewalls of the package 2 are pressed against the vertical plates 18 and 19. As shown in FIG. 5, the bottom corner 16 which are thus formed, are fixed to the bottom plate 17 with the aid of the pressure pad 24, which is pivotable about the axis 25. The pivoting of the pressure pad 24 occurs by means of the activation of the pressure pad in the direction of the double arrow 28.

What is claimed is:

1. An apparatus for forming, filling and closing packages especially made from cardboard, having a plurality of serially arranged processing stations, said apparatus comprising:

a plurality of sets of cassettes with each set having different sizes of cassettes corresponding to predetermine different package formats, each cassette being adapted for receiving therein flat one side open package having a format corresponding to said cassette format for spreading said flat package within said cassette, detachable means for moving each of said cassette with package spread therein or transportation of said packages between said processing stations, wherein said cassettes are substantiallay U-shaped, each cassette including two vertical plates which face one another, and a common bottom plate extending therebetween;

said apparatus further comprising a spreading device for spreading said package apart, said spreading device including movable profile plates, which press the package against the interior sides of vertical plates of said cassette, and form bottom flaps that extend laterally from the edge of the bottom of the package; and pressure pads moving with the cassettes along a portion of their path and movable along the sides of said vertical plates, and equipped for fixing or holding down said bottom flaps.

2. An apparatus according to claim 1, wherein said cassettes are movable along stationary glide strips along their two open sides.

3. An apparatus according to claim 2, wherein said cassettes are movable in opposite directions along at least two coplanar longitudinal paths defined by said glide strips which are parallel to one another, and wherein at the end of each longitudinal path, said cassettes are moved transversely onto the beginning of the other longitudinal path.

4. An apparatus according to claim 3, wherein the glide strips between said two adjacent longitudinal paths terminate prior to transverse transportation areas located at the ends of said longitudinal paths.

5. An apparatus according to claim 4, wherein said vertical plates of said cassettes are fixable on the common bottom plate in different positions.

6. An apparatus according to claim 5, further comprising cylinder piston units for driving said cassettes between said stations.

7. An apparatus according to claim 6, further comprising an ejection unit for pushing filled and closed packages out of said cassettes, said unit being provided at the end of the second longitudinal transportation path.

8. An apparatus according to claim 1, wherein said profile plates have rounded off edge areas.

9. An apparatus according to claim 8, said pressure pads are mounted on said bottom plate movable along the sides of said profile plates, and equipped for fixing the lateral flaps to the bottom plate.

10. An apparatus according to claim 9, wherein said pressure pads are designed as welding elements.

11. An apparatus according to claim 10, wherein said pressure pads are pivotable about horizontal axes.

12. An apparatus according to claim 11, wherein said spreading device is operated by means of a cylinder piston unit.

* * * * *